US006942140B2

(12) United States Patent
Merzeau

(10) Patent No.: US 6,942,140 B2
(45) Date of Patent: Sep. 13, 2005

(54) CARTON WITH HANDLE AND BLANK THEREOF

(75) Inventor: Julien Merzeau, Deols (FR)

(73) Assignee: MeadWestvaco Packaging Systems LLC, Stamford, CT (US)

( * ) Notice: Subject to any disclaimer, the term of this patent is extended or adjusted under 35 U.S.C. 154(b) by 0 days.

(21) Appl. No.: 10/825,041

(22) Filed: Apr. 15, 2004

(65) Prior Publication Data

US 2004/0256445 A1 Dec. 23, 2004

Related U.S. Application Data

(63) Continuation of application No. PCT/US02/33271, filed on Oct. 18, 2002.

(30) Foreign Application Priority Data

Oct. 18, 2001 (GB) ..... 0125070

(51) Int. Cl.[7] ..... B65D 5/468

(52) U.S. Cl. ..... 229/117.22; 206/427; 206/434; 229/117.13

(58) Field of Search ..... 229/117.12, 117.13, 229/117.22; 206/141, 427, 428, 434

(56) References Cited

U.S. PATENT DOCUMENTS

| | | | | |
|---|---|---|---|---|
| 2,800,268 A | | 7/1957 | Mathews | |
| 2,811,250 A | | 10/1957 | Arneson | |
| 2,946,621 A | | 7/1960 | Williamson | |
| 3,300,119 A | * | 1/1967 | Chaussadas | 206/434 |
| 3,353,709 A | * | 11/1967 | Lawrence | 206/141 |
| 3,955,745 A | * | 5/1976 | Forrer | 229/117.12 |
| 4,166,570 A | | 9/1979 | Lazerand et al. | |
| 4,222,485 A | * | 9/1980 | Focke | 206/141 |
| 4,498,619 A | * | 2/1985 | Roccaforte | 229/117.13 |
| 4,637,515 A | | 1/1987 | Wilson et al. | |
| 4,747,534 A | | 5/1988 | Marie | |
| 4,784,266 A | | 11/1988 | Aussadas | |
| 5,381,891 A | * | 1/1995 | Harris | 206/141 |
| 5,595,292 A | | 1/1997 | Bates | |
| 5,699,957 A | | 12/1997 | Blin et al. | |
| 5,878,946 A | * | 3/1999 | Frerot et al. | 229/117.13 |
| 5,906,313 A | * | 5/1999 | Oliff | 229/117.13 |
| 6,065,590 A | * | 5/2000 | Spivey | 206/141 |
| 6,129,266 A | | 10/2000 | Oliff et al. | |
| 6,273,330 B1 | | 8/2001 | Oliff et al. | |

FOREIGN PATENT DOCUMENTS

| | | |
|---|---|---|
| DE | 2756374 A | 5/1980 |
| EP | 0305226 A1 | 3/1989 |

* cited by examiner

*Primary Examiner*—Gary E. Elkins
(74) *Attorney, Agent, or Firm*—Tsugihiko Suzuki

(57) ABSTRACT

A carton and blank for forming a carton for holding a plurality of articles. The carton includes a series of hinged wall panels forming a sleeve including a top panel and opposed side panels hingedly connected to the top panel. The carton further comprises a continuous strap handle formed from the carton and extending entirely across the top panel and one of the side panels. The strap is so connected at its opposite ends as to provide a surplus of material to enable a user part of the handle to be brought into a position of use.

15 Claims, 7 Drawing Sheets

CARTON WITH HANDLE AND BLANK THEREOF

This is a continuation of international application No. PCT/US02/33271, filed Oct. 18, 2002, which is hereby incorporated by reference.

BACKGROUND OF THE INVENTION

This invention relates to a carton which is particularly but not only suitable for accommodating beverage containers such as cans and which incorporates a "strap-type" carrying handle which is automatically set up into a position of use as the carton is being closed after having been loaded.

Beverage cartons, which include carrying handles and indeed, strap type-carrying handles are known. For example, U.S. Pat. No. 4,166,570 (Lazerand et al) discloses a packaging carton for beverage cans with a strap type handle. The handle strap has a central user portion exposed to view in a handle access aperture in top wall of the carton, extends across the top wall and has opposite ends which terminate in respective ones of a pair of end closure flaps which are hinged to the top wall. The handle strap is reinforced by a separate strip of reinforcing material, for example, a fibrous tape.

Lifting a carton and its contents by a strap handle causes the weight of the package to be concentrated at the handle and certain areas of the panels to which the handle is attached. The concentration of weight produces stress that can cause deformation and failure of the handle and various carton panels.

A further problem with known strap handles is that once it is in a set up condition, the nature of paperboard will tend to make the strap return to its original position, which is undesirable.

The present invention seeks to overcome or at least mitigate the problems of the prior art.

SUMMARY OF THE INVENTION

One aspect of the invention provides a carton for holding a plurality of articles which carton comprises a series of hinged wall panels forming a sleeve including a top panel and opposed side panels hingedly connected to the top panel and a continuous strap handle formed from the carton and transversely extending entirely across the top panel and one of the side panels, the strap is so connected at its opposite ends as to provide a surplus of material to enable a user part of the handle to be brought into a position of use.

Preferably there further comprises a web is provided to interconnect the strap handle to one of the top or side panels.

According to an optional feature of this aspect of the invention the strap handle is defined by first and second pairs of juxtaposed cuts, the cuts of the first pair are disposed entirely across the top panel and extend into one of the side panels, the cuts of the second pair are disposed in the one side panel and extend from positions at a lateral space respectively from the cuts of the first pair to the adjacent side edge of a base panel. Optionally, a pair of juxtaposed fold lines extends between each cut of the first pair and the adjacent cut of the second pair to define a web there between for interconnecting the handle and the one side panel.

In one class of embodiments, the strap handle extends into the base panel. Preferably, the end of the strap handle adjacent to the base panel includes a portioned positioned between two adjacent articles in the carton to retain the handle in a position of use and/or to restrict relative movement between adjacent articles.

Preferably there further comprises a pair of load retaining apertures struck from the strap handle to retain said two adjacent articles.

A second aspect of the invention provides a blank for forming a carton for holding articles which blank includes in series hinged wall panels for forming a sleeve including a top panel and opposed side panels hingedly connected to the top panel and a continuous strap handle formed from the blank and transversely extending entirely across the top panel and one of the side panels, the strap is so connected at its opposite ends as to provide a surplus of material to enable a user part of the handle to be brought into a position of use in a set up condition.

Preferably there further comprises a web is provided to interconnect the strap handle to one of the top or side panels.

According to an optional feature of the second aspect of the invention the strap handle is defined by first and second pairs of juxtaposed cuts, the cuts of the first pair are disposed entirely across the top panel and extend into one of the side panels, the cuts of the second pair are disposed in the one side panel and extend from positions at a lateral space respectively from the cuts of the first pair to the adjacent side edge of the base panel.

Optionally, a pair of juxtaposed fold lines extends between each cut of the first pair and the adjacent cut of the second pair to define a web there between for interconnecting the handle and the one side panel.

In one class of embodiments, the strap handle extends into the base panel. Preferably, the end of the strap handle adjacent to the base panel includes a portioned positioned between two adjacent articles in the carton to retain the handle in a position of use and/or to restrict relative movement between adjacent articles.

BRIEF DESCRIPTION OF THE DRAWINGS

Exemplary embodiments of the invention will now be described, by way of example only, with reference to the accompanying drawings in which.

DETAILED DESCRIPTION OF THE PREFERRED EMBODIMENTS

Figure 1:
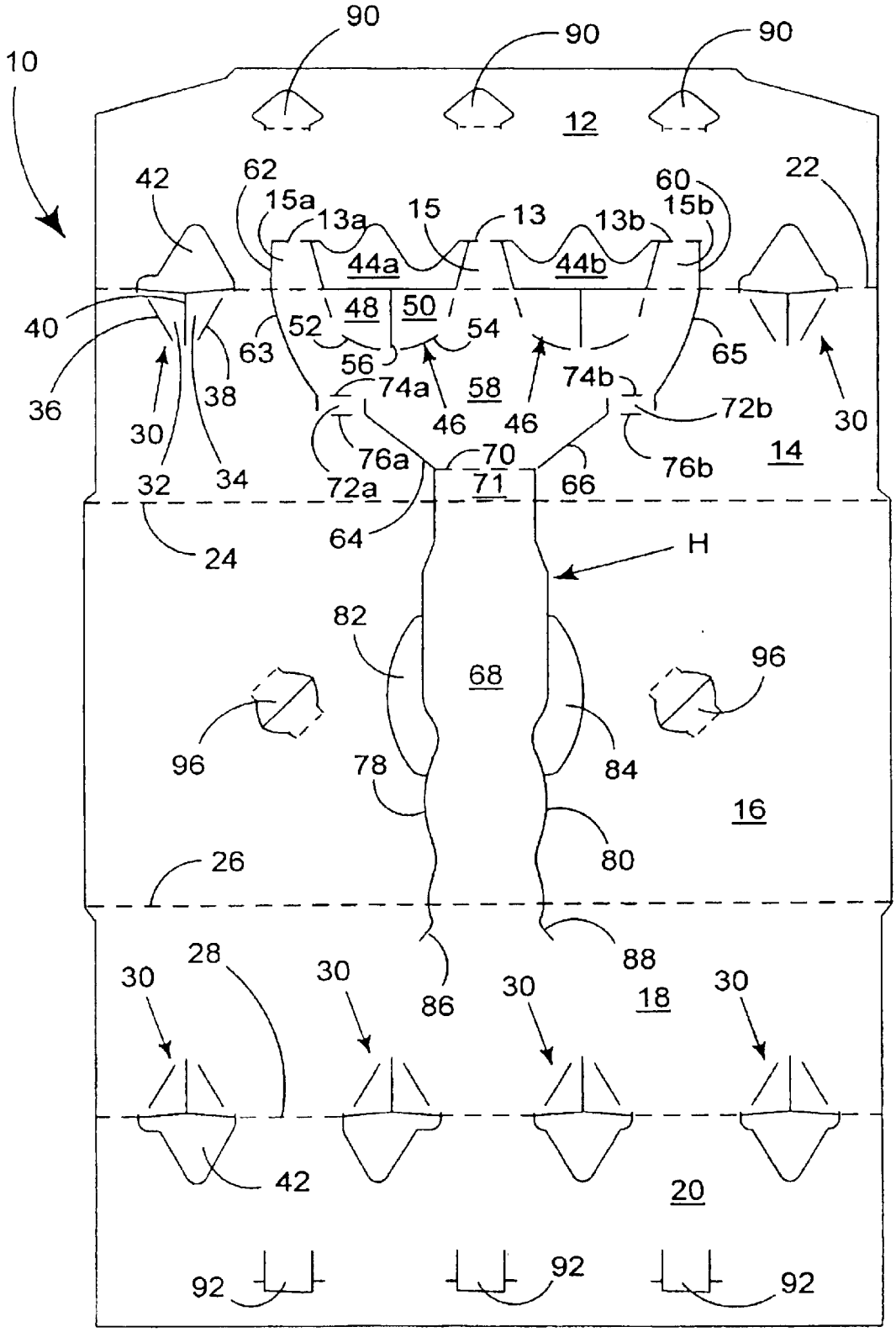
FIG. 1 is a plan view of a blank of a wraparound carton incorporating one aspect of the invention.
Figure 2:
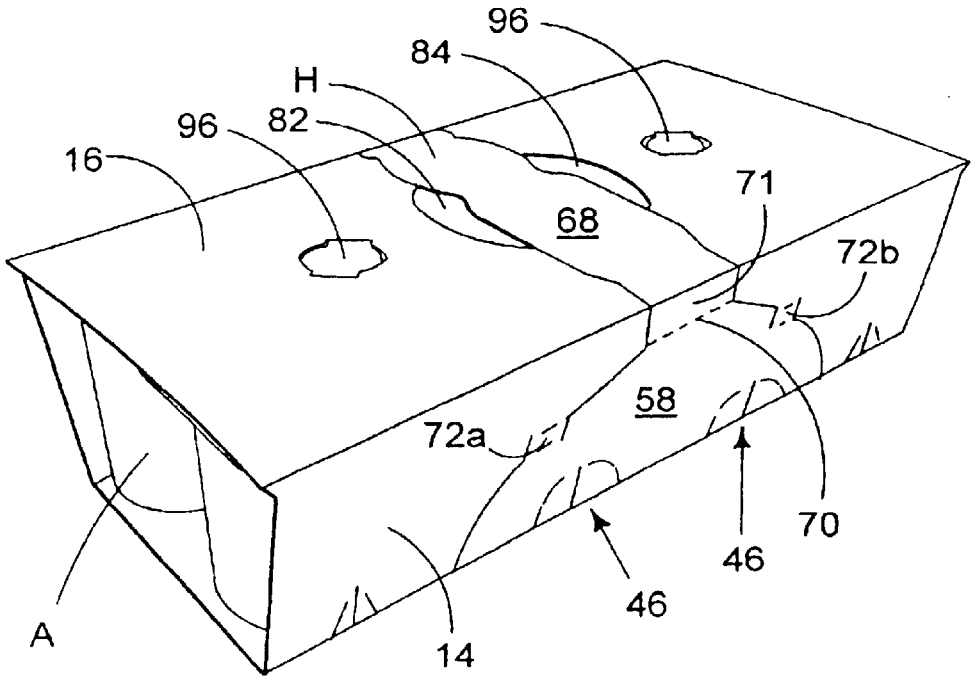
FIG. 2 is a perspective view of the carton in a set up condition formed from the blank of FIG. 1.

Referring to the drawings and in particular FIGS. 1 and 2 thereof, a carton is formed from a unitary blank 10 made from paper board or other suitable foldable sheet material, which can be adapted to accommodate the variety of articles such as cans, bottles or cups in variety of arrangements, for example six bottles arranged in two rows of three bottles each. It is envisaged the carton can be adapted to accommodate a different number of articles according to user requirements.

Turning to the carton blank 10 of the first embodiment illustrated in FIG. 1, this blank includes panels for forming a top, a base and opposed sides. The blank is arranged so that there comprises a first base panel 12, first side wall panel 14, top panel 16, second side wall panel 18, and second base panel 20 hingedly connected one to the next in a series along fold lines 22, 24, 26 and 28 respectively.

There may further comprise one or more article engaging structures 30 for engaging an article or articles. Preferably, each structure 30 comprises a pair of oppositely disposed flaps 32, 34 hingedly connected to first side panel 14 or second side panel 16 along fold lines 36 and 38 respectively. Preferably, fold lines 36 and 38 diverge inwardly of the aperture defined by flaps 32, 34 in the respective side wall panel. Fold lines 36, 38 are convergent in an upward direction as viewed in FIGS. 2 and 3. A cut line 40 separates adjacent flaps 32, 34.

The lower edges of flaps 32, 34 define an edge of a tightening aperture 42. For tightening the carton around a group of articles, tightening apertures 42 are formed in first base panel 12 while similar tightening apertures 42 are formed in second base panel 20. With the carton disposed about a group of articles and with the base panels 12 and 20 disposed in an overlapping relationship, machine elements enter the tightening apertures 42 and move towards the other, so as to tighten the carton about the group of articles as is well known. After the carton is tightened, it is locked by suitable securing means, for example locking tabs 90 which are driven through the apertures defined by retaining tabs 92 respectively. The configurations of locking tabs and retaining tabs 90, 92 are well known and the locking operation is well understood.

In one class of embodiments, a stabilizing (or bottle neck spacer) flap 96 shown in FIG. 1 is struck from the top panel 16 so that the flap 96 is hinged to top panel 16 but otherwise cut out from the blank.

The blank of FIG. 1 further comprises a strap handle H having a central user portion 68, which in this embodiment is frangibly connected to the top panel 16. The central user portion 68 is formed from top panel 16 and extends entirely across the top panel 16. The handle H extends into first and second side panels 14, 18.

The central user portion 68 is separated from the top panel by opposed cut lines 78 and 80. Preferably, there further comprises one or more apertures 82 and 84 positioned along each longitudinal edge of central user portion 68 to make it easier for a user to grip the central user portion.

The handle H extends into first side wall panel 14 and is defined, at least in part, by side handle panel 58. Side handle panel 58 is separated from side wall panel 14 by two pairs of opposed or juxtaposed cut lines 64, 66; and 63, 65. The cut lines 64, 66 of the upper pair are the respective extensions of cut lines 78, 80 and extend downwardly from fold line 24 to web panels 72*a*, 72*b* respectively. The cut lines 63, 65 of the lower pair extend downwardly from web panels 72*a*, 72*b* at the positions laterally spaced respectively from the cut lines 64, 66 to fold line 22. Cut lines 64, 66 further define an intermediate panel 71 in the side panel 14. There is only one intermediate panel 71 in this embodiment; however, The handle H may comprise two or more intermediate panels for connecting the side handle panel 58 to the central user portion 68. In FIG. 1 intermediate panel 71 is hingedly connected to side handle panel 58 along fold line 70 and to central user portion 68 along fold line 24. Accordingly, the handle H extends entirely across the first side panel 14 also.

It is preferred that the handle H extends further into base panel 12 and is hingedly connected thereto. In the embodiment of FIG. 1, the handle H further comprises base handle panels 15, 15*a*, 15*b* struck from and hingedly connected to base panel 12 along fold lines 13, 13*a*, 13*b*. Base handle panels 15, 15*a*, 15*b* are hingedly connected to side handle panel 58 along an extension of fold line 22. In use, the handle H will pivot inwardly along fold line 13, 13*a*, 13*b*, described in more detail below, so as to raise the central user portion 68 above the top wall panel 16 and into a position of use.

In one class of embodiments, the handle H is hinged to one of the side or top panels 14, 16 intermediate the ends of the handle, by means of a web structure. In this embodiment, the web structure is provided by the aforementioned web panels 72*a*, 72*b*. The first web panel 72*a* hingedly interconnects the side handle panel 58 and side wall panel 14 along juxtaposed fold lines 74*a* and 76*a* while the second web panel 72*b* hingedly interconnects the opposing edge of side handle panel 58 and side wall panel 14 along juxtaposed fold lines 74*b* and 76*b*. Fold lines 74*a*, 76*a* extend between cut line 64 of the upper pair and the adjacent cut line 63 of the lower pair and thereby define the first web panel 72*a* therebetween. Fold lines 74*b*, 76*b* extend between cut line 66 of the upper pair and the adjacent cut line 65 of the lower pair and thereby define the second web panel 72*b* therebetween. The web panels 72*a*, 72*b* restrict the degree of movement of the handle so improving the structural integrity of the handle whilst retaining a degree of flexibility. The web panels 72*a*, 72*b* also contribute to the connection between the opposed end portions of side wall panel 14 so as to enhance the structural integrity of side wall panel 14. The web panel further helps to dissipate the stresses from handling the package.

It is envisaged that the web structure is not limited to the embodiment described in the preceding paragraph. Indeed, it is envisaged that the web structure can be arranged so as to hinge the handle to the top panel without departing from the scope of invention.

In FIG. 1, as the web structure connects the side wall panel 14 to the side handle panel 58 there comprises two pairs of cut lines 64, 66 and 63, 65 defining the side handle panel 58, separated by the web panels 72*a* and 72*b* respectively.

In order to provide a stronger handle structure, it is preferable for the handle H to widen towards its ends and to this end, the cut lines 64, 66 and 63, 65 of the side handle panel 58 may diverge toward the first base panel 12.

A further preferred feature is to provide one or more article retention structures within the handle H which perform two purposes: (i) to reduce movement between adjacent articles, thereby to improve the rigidity of the package; and (ii) to maintain the handle H in a set up condition after it has been placed in a position of use.

In the embodiment of FIG. 1, there are two article retention structures 46. Each article retention structure 46 is identical and therefore only one of them will now be described. The retention structure comprises a pair of article receiving flaps 48 and 50 struck from and hingedly connected to side handle panel 58 along fold lines 52 and 54. A cut line 56 separates the article receiving flaps 48 and 50. In some embodiments there may further comprise tightening apertures 44*a* and 44*b* which function in like manner to apertures 42, described above. Fold lines 52 and 54 are arranged to provide an interference type fit with an article that is retained.

As the or each article retention structure 46 is positioned intermediate the opposed cut lines 63, 65 forming the handle H, the base handle panels 15*a* and 15*b* are separated from base panel by cut lines 60 and 62. In use, the base handle panels function in identical manner to base handle panel 15.

The handle H may extend into the second side wall panel 18 in like manner as the first side wall panel 14, by providing one or more of a side handle panel, a web structure, one or more base handle panels or an article retention structure. However, in the embodiment of FIG. 1, the central user portion 68 extends into second side wall panel 18 by extending cut lines 78 and 80 into second side wall panel 18. Preferably the cut lines defining this end of the handle H diverge outwardly as designated by reference numerals 86 and 88, so as to dissipate the stresses associated with lifting the handle H and reduce the risk of tearing the second side wall panel 18.

An additional handle strap (not shown) can be applied to the inner surface of the blank 10, being secured to the central user portion 68 by glue or other means known in the art. It is further preferred the handle strap is formed from paper board, laminated paper board, fibrous tape or other suitable plastics material.

Figure 3:
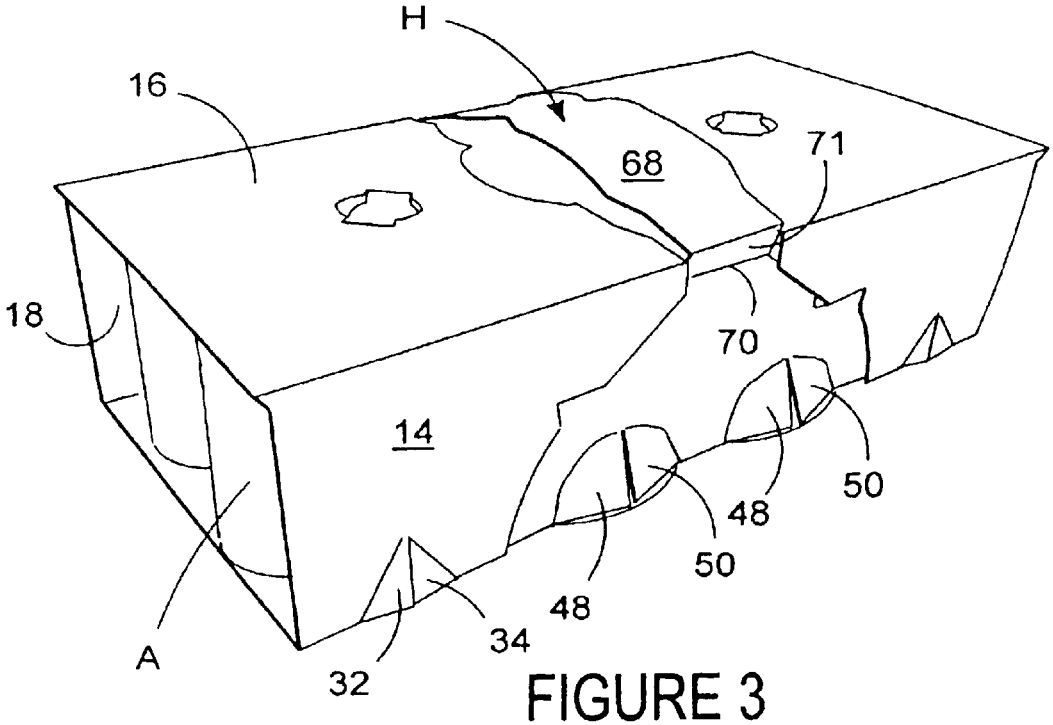
FIG. 3 is a perspective view of the carton shown in FIG. 2 with the handle in a position of use.
Figure 4:
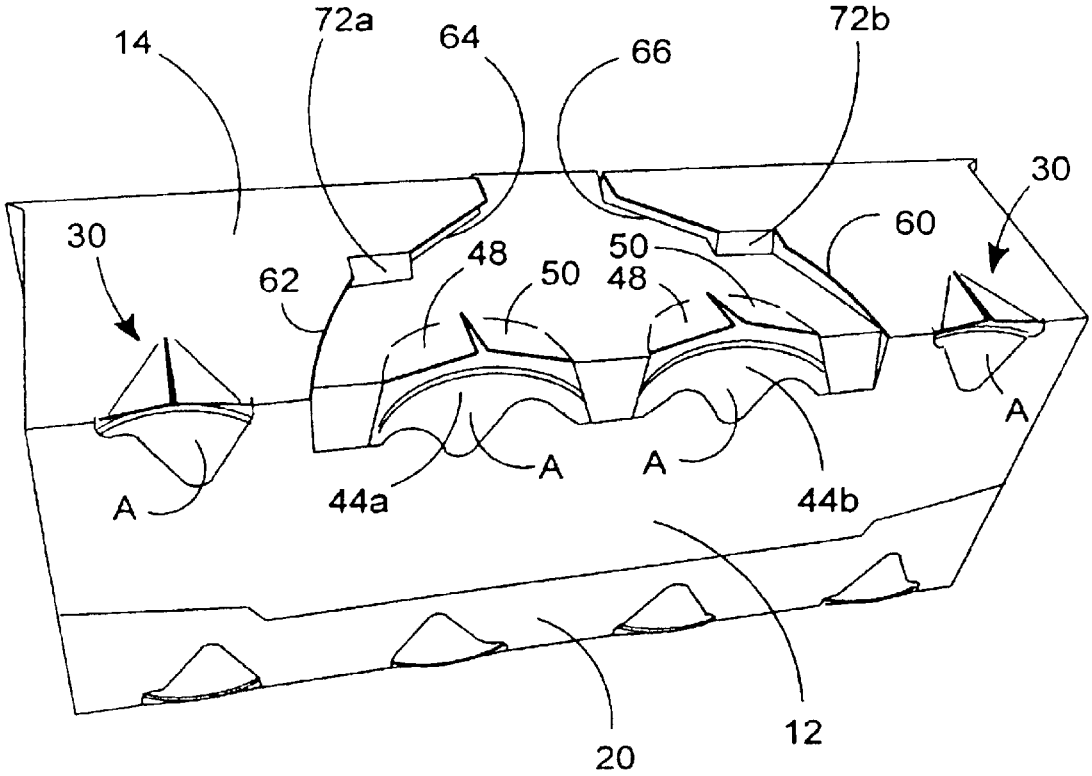
FIG. 4 is a perspective view from below of the carton in FIG. 3 showing the handle portion.

Turning to the construction of the carton, illustrated in FIGS. 2, 3 and 4, the blank requires a series of sequential folding and, optionally, gluing operations which can be performed in a straight line machine so that the carton is not required to be rotated or inverted to complete its construction. The folding process is not limited to that described below and can be altered according to particular manufacturing requirements.

Articles are held together in an array, for example two rows of four articles A and the carton blank is introduced to the articles A. In this embodiment, the blank 10 is introduced from above. The side panels 14, 18 of the blank are then folded about fold lines 24 and 26 respectively such that the side panels are folded downwardly with respect to top panel 16.

The article engaging structures 30 are also formed by folding outwardly to define receiving apertures as is well known, and base panels 12 and 20 are folded out of alignment with side wall panels 14 and 18. The side wall panels 14, 18 and base panels 12, 20 are brought into contact with the respective articles A, such that the lower portion of articles A protrude through apertures defined by the engaging flaps 32, 34 and are held in position thereto as shown in FIG. 3.

Thereafter, base panels 12 and 20 are brought into overlapping relationship and connected or secured together by glue or by the locking means to form the base of the carton as hereinbefore described. Thus, the carton is in a set up and loaded condition as shown in FIG. 2.

In order to form the handle H, reference is made to FIGS. 3 and 4. The central user portion 68 is detached from the top panel 16 along cut lines 78, 80, by an end user so that at least a portion of the handle H stands proud of the top panel 16 as shown in FIG. 3. When the central user portion 68 is raised, the side handle panel 58 is displaced inwardly. Thus, if the handle panel terminates at the bottom of side wall panel 14, it is folded inwardly along the fold line 22 connecting the side wall panel 14 and the base panel 12. In those embodiments with a web structure, the web panels 72*a*, 72*b* are folded inwardly along fold lines 76*a*, 76*b*.

By causing the web panels 72*a*, 72*b* and side handle panel 58 to move inwardly, it provides a surplus of material to enable the central user portion 68 to be placed in a position of use, similar to that shown in FIG. 3. In the preferred embodiment of FIG. 1, the handle H extends into base panel 12 by base handle panels 15, 15*a* and 15*b*, so the handle is folded inwardly along fold lines 13, 13*a* and 13*b*. This action causes the base handle panels 15, 15*a*, 15*b* to be folded upwardly and inwardly and side handle panel 58 to be displaced inwardly with respect to side wall panel 14. Likewise, intermediate panel 71 is folded out of a collinear arrangement with side handle panel 58 along fold line 70 so as to assist imparting a degree of curvature to the handle H once it is in a position of use.

In those embodiments with one or more article retention structures 46, as the side handle panel 58 is displaced inwardly, the article engaging flaps 48 and 50 are caused to be folded outwardly along fold lines 52 and 54, as shown in FIGS. 3 and 4. It will be seen from FIG. 4 that base handle panels 15, 15*a* and 15*b* are sized and shaped to be placed intermediate a bottom portion of the articles so as to provide an interference type fit. Furthermore, the edge of the apertures formed by engaging flaps 48 and 50 are shaped to engage a lower portion of the article so that the side handle panel 58 is restricted from any outward movement once displaced inwardly.

By connecting the side handle panel 58 to the side wall panel 14 by the web panels 72*a*, 72*b*, the upward movement of the handle H will cause the web panels 72*a*, 72*b* to be folded into a proximate face to face arrangement with side wall panel 14, shown in FIG. 4. This, in turn, pulls the side wall panel 14 inwardly towards the article thereby preventing or at least restricting the web panels 72*a*, 72*b* from being folded back to its original position. Thus, the handle H is maintained in a set up condition, shown in FIGS. 3 and 4 by the web structure and, separately, the engagement of the article with the side handle panel 58 and/or the base handle panels 15, 15*a*, 15*b*.

Figure 5:
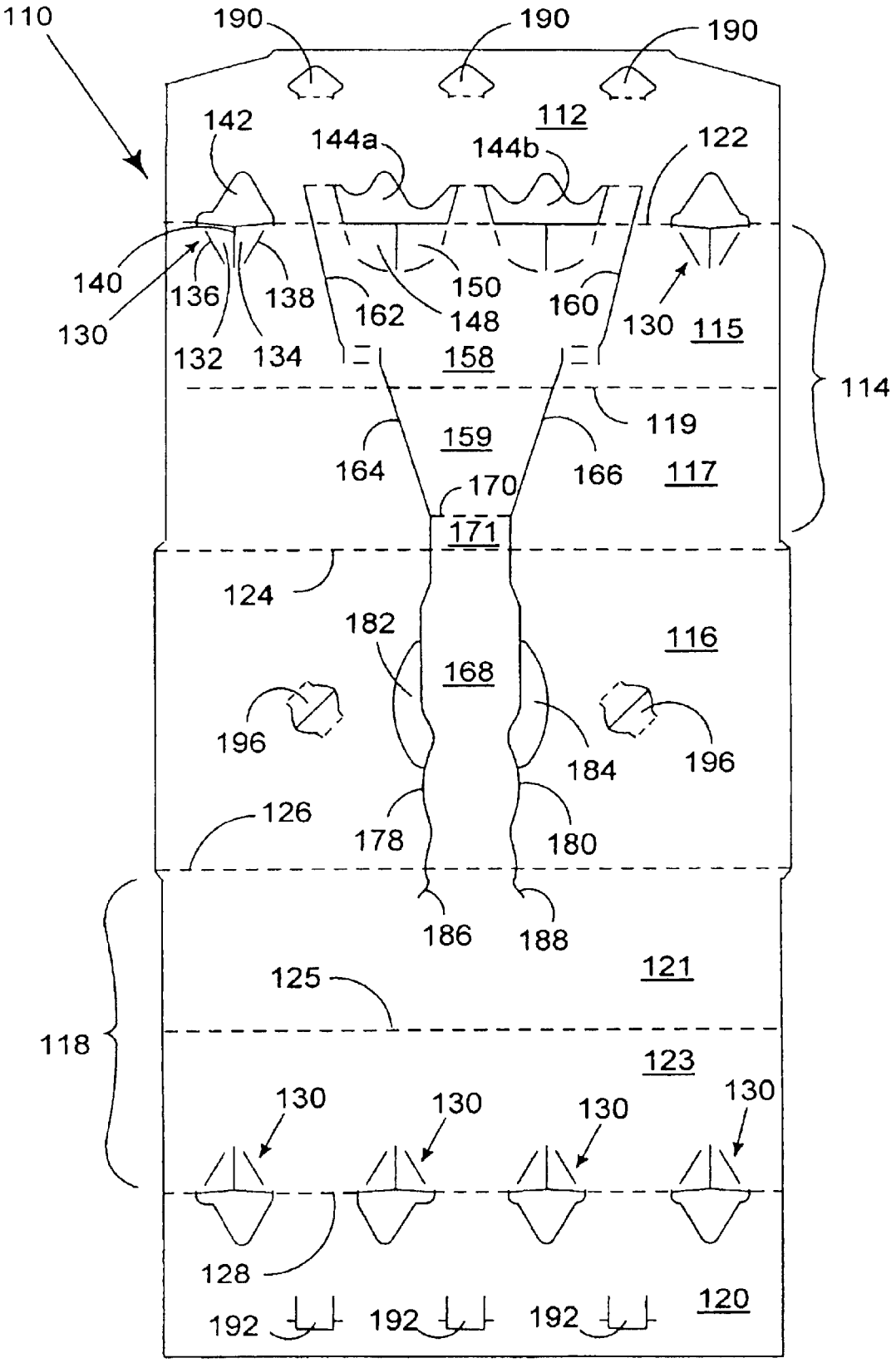
FIG. 5 is a plan view of a blank according to a second embodiment of the invention.
Figure 6:
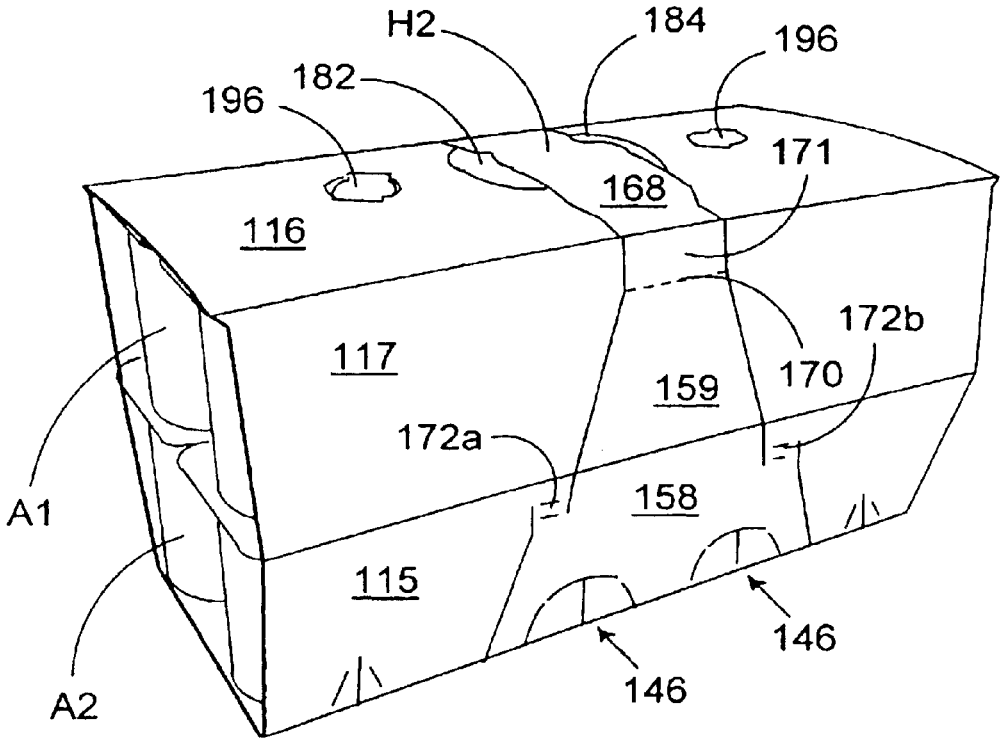
FIG. 6 is a perspective view of the carton in a set up condition formed from the blank of FIG. 5.
Figure 7:
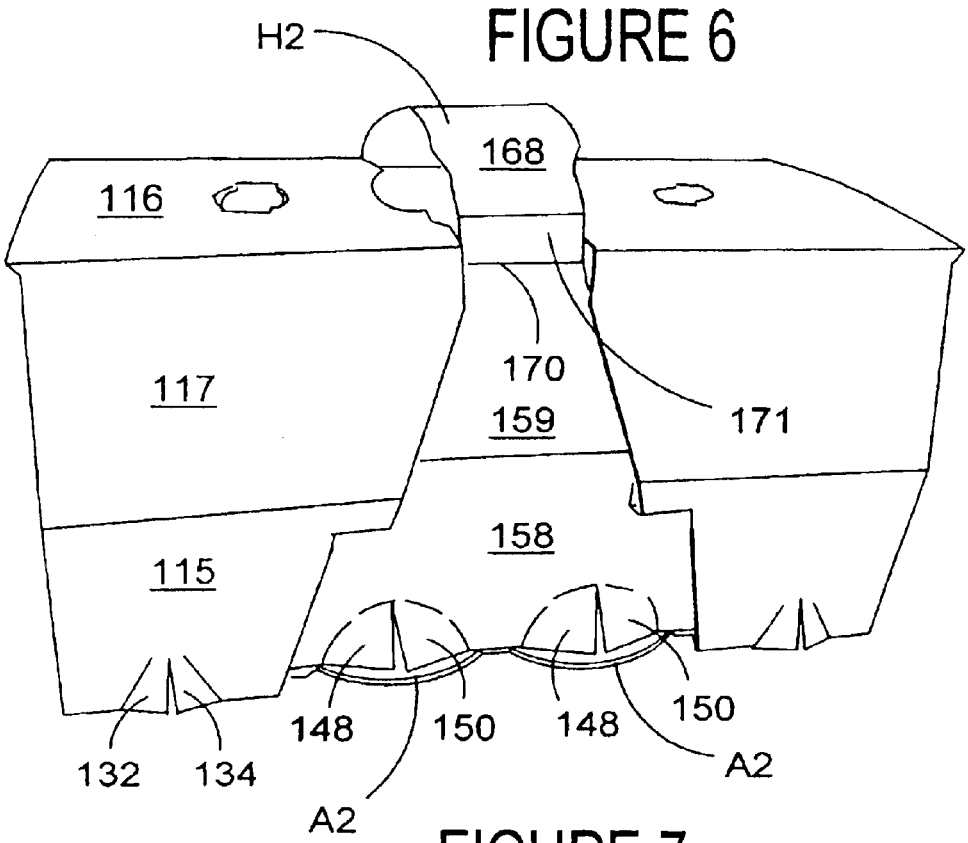
FIG. 7 is a perspective view of the carton shown in FIG. 6 with the handle in a position of use.

Turning to the second embodiment of the invention, shown in FIGS. 5, 6 and 7, the blank and carton are designed for a plurality of articles arranged in two tiers of articles A1, A2. Therefore, the side wall structures and handle structure is altered accordingly. The second embodiment is similar to the first embodiment and therefore like parts are designated by the same reference numeral but with the prefix '1'. Therefore, only the differences will now be described.

It will be seen from FIG. 5 that side wall panel 114 comprises upper and lower side wall panel portions 117 and 115 hingedly connected together along fold line 119. In this embodiment, the side handle panel 158 is formed in the lower side panel portion 115, but it could be formed in the upper side panel portion 117, without departing from the scope of invention. In order to connect the side handle panel 158 to the central user portion 168, there further comprises a second intermediate panel 159 hingedly connected to side handle panel 158 along an extension of fold line 119 and to first intermediate panel 171 along fold line 170. The web structures are formed in lower side wall panel portion 115, although they could of course be positioned in upper side wall panel portion 117 or indeed in the top panel 116, without departing from the scope of the invention.

As shown in FIGS. 6 and 7, the second embodiment is constructed in identical manner to the first embodiment and likewise the handle structure H2 too is formed in a like manner so will not be described in any greater detail.

Figure 8:
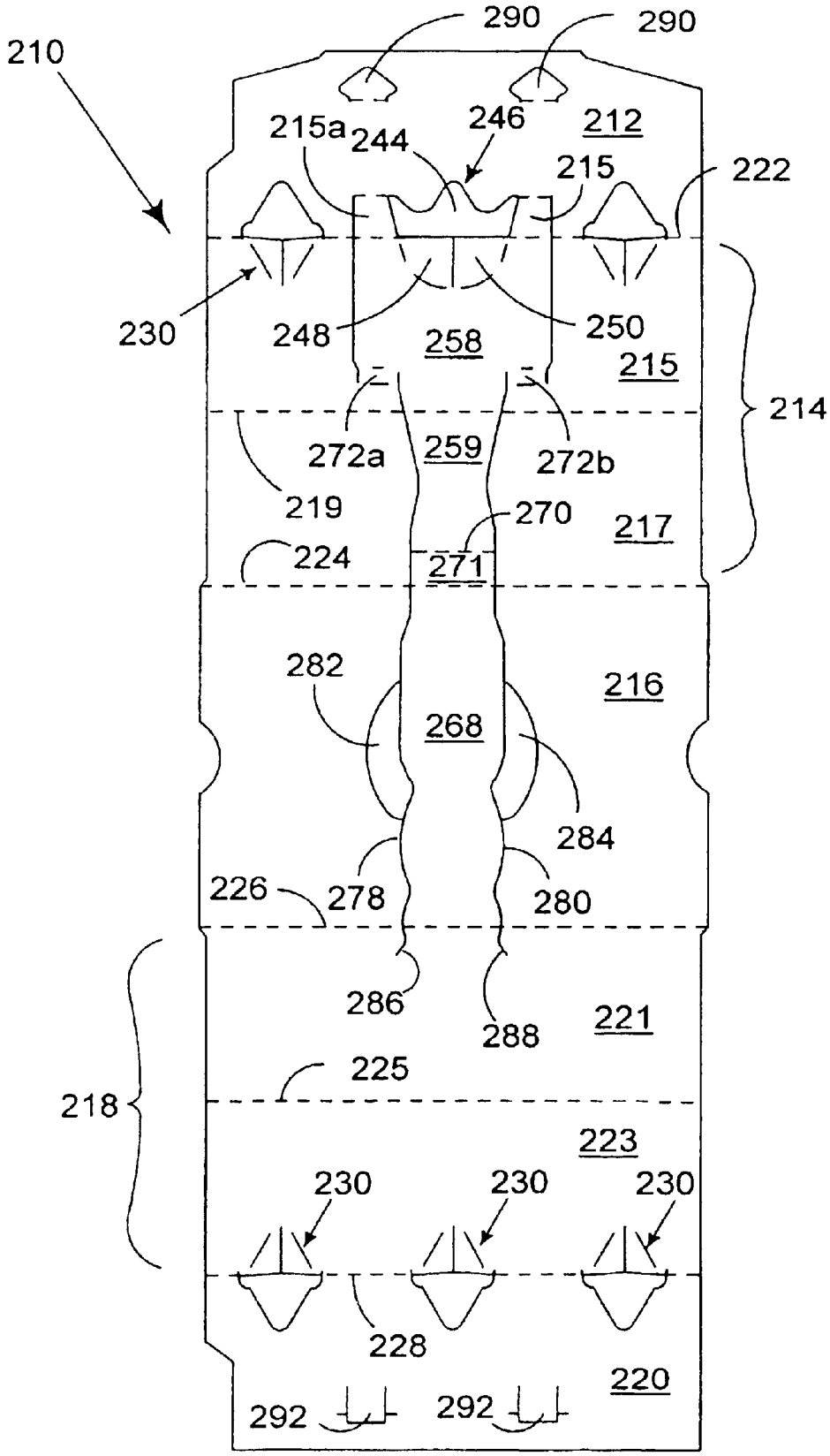
FIG. 8 is a plan view of a blank according to a third embodiment of the invention.
Figure 9:
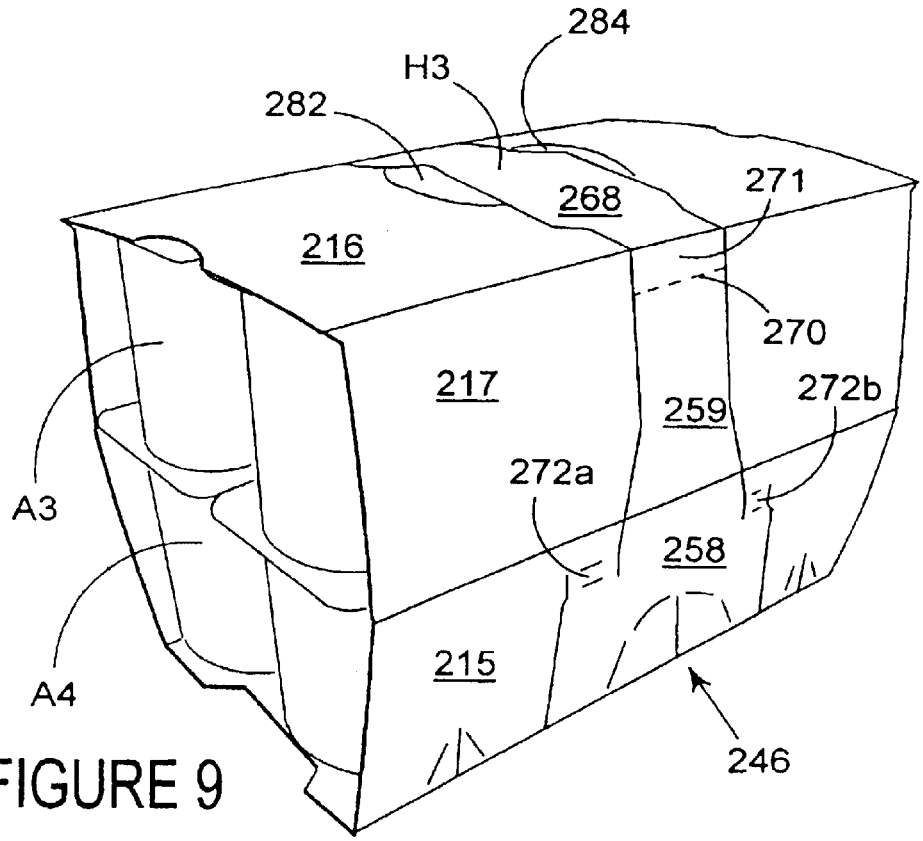
FIG. 9 is a perspective view of the carton in a set up condition formed from the blank of FIG. 8.
Figure 10:
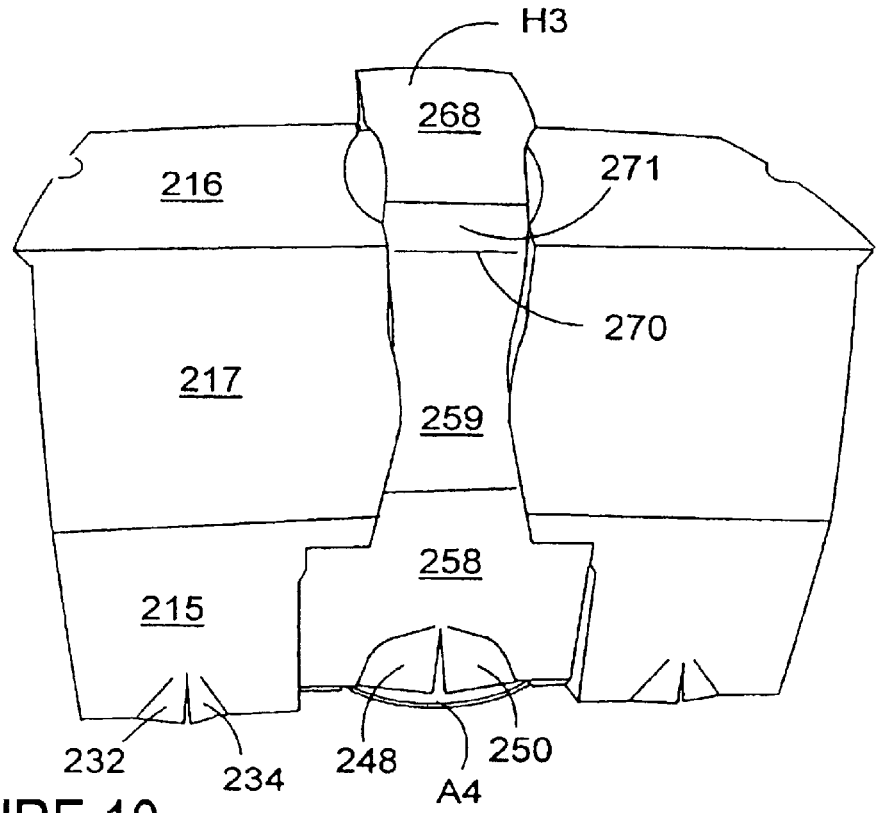
FIG. 10 is a perspective view of the carton shown in FIG. 9 with the handle in a position of use.

Turning to the third embodiment shown in FIGS. 8, 9 and 10, the carton is constructed to receive two tiers of articles A3, A4 each tier having a group arranged in a two by three formation. Again, the general structure of the carton and the handle is very similar to the first and second embodiments with like references being used, but this time with the prefix '2'. Again only differences with respect to the second embodiment will now be described.

In this embodiment, there comprises a single article retention structure 246 formed from side handle panel 258.

The article retention structure 246 is identical to that described in the first embodiment and comprises a pair of article engaging flaps 248 and 250. In this embodiment, the base handle panel 215 is struck from one side of the article retention structure 246 and there further comprises a second base handle panel 215*a* struck from the base panel 212 along the opposing side of the article retention structure 246. As this is a two tier structure, there also comprises a second intermediate panel 259 hingedly interconnecting side handle panel 258 and first intermediate panel 271 along fold lines 219 and 270 respectively.

The third embodiment is constructed in a like manner to the first and second embodiments and therefore will not be described in any greater detail but is illustrated in FIGS. 9 and 10.

The invention and its preferred embodiments provide a pack with a handle which can be moved from a flat collapsed position with respect to the top panel 216 to a position of use and is held in place by the handle structure. Beneficially, this makes it easier for a user to reuse the handle. The web structure and handle structure arrangement imparts a degree of flexibility in the handle so that the stresses created when handling the carton are dissipated across a larger area and absorbed in the side wall and base wall structures thereby to reduce the risk of unwanted tearing.

It will be recognized that as used herein, the terms "top", "bottom", "base", "side", "upper", "lower", "inner", "outer" with respect to the panels of the carton are relative terms, and that the carton may be re-oriented as necessary or as desired. Any reference to hinged connections should not be construed as necessarily referring to a single fold line only; indeed it is envisaged that a hinged connection can be formed from a score line, a frangible line or one, two or more fold lines without departing from the scope of invention.

The present invention and its preferred embodiment relate to a package, which is shaped to provide satisfactory strength to hold articles securely but with a degree of flexibility so that load transfer to the handle is absorbed by the carton. The shape of the blank minimizes the amount of paperboard required and the carrier can be applied to an array of articles by hand or automatic machinery. It is anticipated that the invention can be applied to a variety of carriers and is not limited to the wrap around type. For example, the handle H of the aforementioned carton can be applied to a top gripping carton or fully enclosed carton without departing from the scope of the invention.

What is claimed is:

1. A carton for holding a plurality of articles, comprising a series of hinged wall panels forming a sleeve including a top panel, opposed side panels hingedly connected to the top panel and a base hingedly interconnecting said side panels to form said sleeve, said carton further comprising a continuous strap handle formed therefrom and extending entirely across said top panel and one of said side panels, wherein said strap handle is connected at opposite ends thereof to said carton such that said strap handle provides a surplus of material to enable a user part of said strap handle to be brought into a position of use, and wherein said strap handle extends into said base.

2. The carton as claimed in claim 1 wherein a web structure is provided to interconnect said strap handle to said one side panel.

3. The carton as claimed in claim 1 wherein said strap handle is defined by first and second pairs of juxtaposed cuts, said cuts of said first pair are disposed entirely across said top panel and extend into said one side panel, and said cuts of said second pair are disposed in said one side panel and extend from positions at a lateral space respectively from said cuts of said first pair to a lower edge of said one side panel.

4. The carton as claimed in claim 3 wherein a pair of juxtaposed fold lines extend between each cut of said first pair and an adjacent cut of said second pair to define a web panel therebetween for interconnecting said strap handle with said one side panel.

5. The carton as claimed in claim 1 wherein one of said opposite ends of said strap handle includes a portion for placement between two adjacent articles in said carton, said portion of said one end being formed from said base.

6. The carton as claimed in claim 5 wherein said strap handle has at least one article-retaining aperture struck therefrom to retain at least one of said two adjacent articles.

7. The carton claimed in claim 1 wherein said base comprises a pair of base panels hingedly connected to said side panels respectively, said base panels being secured together in an overlapping relationship to form said base.

8. The carton claimed in claim 7 wherein one of said base panels is hingedly connected to said one side panel, and said strap handle extends into said one base panel.

9. A blank for forming a carton for holding articles, said blank comprising a series of hinged wall panels for forming a sleeve including a top panel, opposed side panels hingedly connected to said top panel and a base panel hingedly connected to one of said side panels, said blank further comprising a continuous strap handle formed therefrom and extending entirely across said top panel and said one side panel, wherein said strap handle is connected at opposite ends thereof to said blank such that said strap handle provides a surplus of material to enable a user part of said strap handle to be brought into a position of use in a set up condition, and wherein said strap handle extends into said base panel.

10. The blank as claimed in claim 9 wherein a web structure is provided to interconnect said strap handle to said one side panel.

11. The blank as claimed in claim 9 wherein said strap handle is defined by first and second pairs of juxtaposed cuts, said cuts of said first pair are disposed entirely across said top panel and extend into said one side panel, and said cuts of said second pair are disposed in said one side panel and extend from positions at a lateral space respectively from said cuts of said first pair into said base panel.

12. The blank as claimed in claim 11 wherein a pair of juxtaposed fold lines extend between each cut of said first pair and an adjacent cut of said second pair to define a web panel therebetween for interconnecting said strap handle with said one side panel.

13. The blank as claimed in claim 9 wherein one of said opposite ends of said strap handle includes a portion for placement between two adjacent articles upon erection of a carton, said portion of said one end being formed from said base panel.

14. The blank as claimed in claim 13 wherein said strap handle has at least one article-retaining aperture struck therefrom to retain at least one of said two adjacent articles.

15. The blank claimed in claim 9 further comprising another base panel hingedly connected to the other side panel, said base panels being secured together in an overlapping relationship in a set up condition.

* * * * *